US007690139B2

(12) United States Patent
Germain et al.

(10) Patent No.: US 7,690,139 B2
(45) Date of Patent: Apr. 6, 2010

(54) HOUSEHOLD PRESSING IRON HAVING AN IMPROVED CORD GUIDE DEVICE

(75) Inventors: Jean-Claude Germain, Saint Laurent de Mure (FR); Laurent D'Oliviera, Saint Chamond (FR); Xavier Vacheron, Genas (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 12/250,948

(22) Filed: Oct. 14, 2008

(65) Prior Publication Data

US 2009/0094866 A1 Apr. 16, 2009

(30) Foreign Application Priority Data

Oct. 12, 2007 (FR) ..... 07 07175

(51) Int. Cl.
*D06F 75/28* (2006.01)
*D06F 79/00* (2006.01)

(52) U.S. Cl. ..... 38/88; 439/40

(58) Field of Classification Search ..... 38/74, 38/77.7, 82, 94, 88; 439/39, 40
See application file for complete search history.

(56) References Cited

U.S. PATENT DOCUMENTS

| | | | | |
|---|---|---|---|---|
| 2,536,996 | A * | 1/1951 | Holland et al. | 174/46 |
| 3,521,216 | A * | 7/1970 | Tolegian | 439/39 |
| 4,748,755 | A * | 6/1988 | Bain et al. | 38/88 |
| 5,390,433 | A * | 2/1995 | Brady | 38/79 |
| 5,768,808 | A * | 6/1998 | Czerner et al. | 38/88 |
| 5,816,825 | A * | 10/1998 | Sekimori et al. | 439/39 |
| 7,017,290 | B2 * | 3/2006 | Bontems et al. | 38/88 |
| 7,123,726 | B2 * | 10/2006 | Tabata et al. | 381/86 |

* cited by examiner

*Primary Examiner*—Ismael Izaguirre
(74) *Attorney, Agent, or Firm*—Browdy and Neimark, PLLC

(57) ABSTRACT

Pressing iron having a body (1) connected to a cord (3), such as a power supply cord, and having a cord guide device (5) giving a preferential orientation to the cord (3) at the exit from the body, the cord guide device (5) being articulated on the body of the iron and being able to rock between a storage position in which the cord guide device (5) is disposed against the body of the iron and an ironing position in which the cord guide device (5) is spaced from the iron, wherein the iron has a magnetic assembly (7) generating a force tending to maintain the cord guide device (5) in storage position.

9 Claims, 2 Drawing Sheets

HOUSEHOLD PRESSING IRON HAVING AN IMPROVED CORD GUIDE DEVICE

BACKGROUND OF THE INVENTION

The present invention relates to a household, or domestic, pressing iron having a body connected to a cord, such as a power supply cord, and comprising a cord guide device giving a preferential orientation to the cord at the exit from the body, and relates more particularly to an iron in which the cord guide device is articulated on the body of the iron and can rock between a storage position in which the cord guide device is disposed against the body of the iron to reduce its obstruction and an ironing position in which the cord guide device makes it possible to move the cord away from the body of the iron.

There are known, from patent applications FR 05 09546 and FR 06 08621, domestic irons having a cord guide device articulated on the body of the iron and being able to rock between a storage position, in which the cord guide device is appreciably integrated into the body of the iron to reduce its obstruction, or bulk, and to facilitate its storage, and an ironing position in which the cord is inclined towards the back of the iron to prevent it from coming to rub against the linen during ironing.

However, such cord guide devices present the disadvantage of tending to rock naturally towards the ironing position because of the weight of the cord and because of a greater stability of the cord guide device in this position. Thus, when the user coils the cord around the iron for storage, it is not rare that the cord guide device rocks naturally into the ironing position, thus increasing the obstruction of the appliance.

BRIEF SUMMARY OF THE INVENTION

The present invention remedies this disadvantage by providing a domestic iron having means to retain the cord guide device in its storage position, these means being very ergonomic to use and simple and economical to produce.

For this purpose, the invention has for its object a fabric pressing iron having a body connected to a cord, such as an electric power supply cord, and comprising a cord guide device giving a preferential orientation to the cord at the exit from the body, the cord guide device being articulated on the body of the iron and being able to rock between a storage position, in which the cord guide device is disposed against the body of the iron, and an ironing position, in which the cord guide device is spaced from the iron, wherein the iron has magnetic means generating a force tending to maintain the cord guide device in storage position.

Such a characteristic has the advantage of allowing the cord guide device to be maintained in the storage position when the iron is not being used, while allowing an automatic rocking of the cord guide device towards the ironing position by a simple pronounced tension, or pull, on the cord during an ironing session.

According to another characteristic of the invention, the magnetic means are constituted by a magnet that cooperates with a ferromagnetic element to maintain the cord guide device in storage position.

According to still another characteristic of the invention, the ferromagnetic element is constituted by an assembly screw of the iron.

According to other particular embodiments, the pressing iron according to the invention can comprise either one or both of the following characteristics:

the cord guide device has a sleeve enveloping the cord at the exit from the body of the iron, the sleeve being articulated on the body of the iron and having a magnet cooperating with a ferromagnetic element carried by the body of the iron to maintain the cord guide device in storage position; and/or the cord guide device has a part in the form of an arch supporting the cord, the arch being articulated by its ends on the body of the iron, the arch having an assembly screw that comes in the immediate vicinity of a magnet carried by the body of the iron when the arch is in storage position.

BRIEF DESCRIPTION OF THE DRAWINGS

The following figures illustrate nonlimiting exemplary embodiments of the invention.

DETAILED DESCRIPTION OF THE INVENTION

Only the elements necessary for a full understanding of the invention have been represented. To facilitate the reading of the drawings, the same elements carry the same references from one figure to another.

Figure 1:
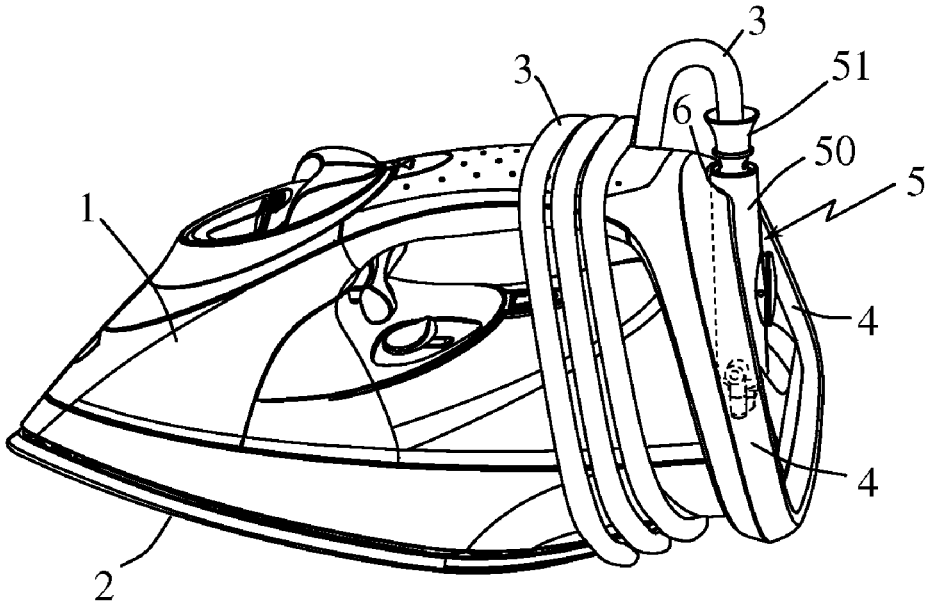
FIGS. 1 and 2 are perspective views of a pressing iron according to a first particular embodiment of the invention.
Figure 2:
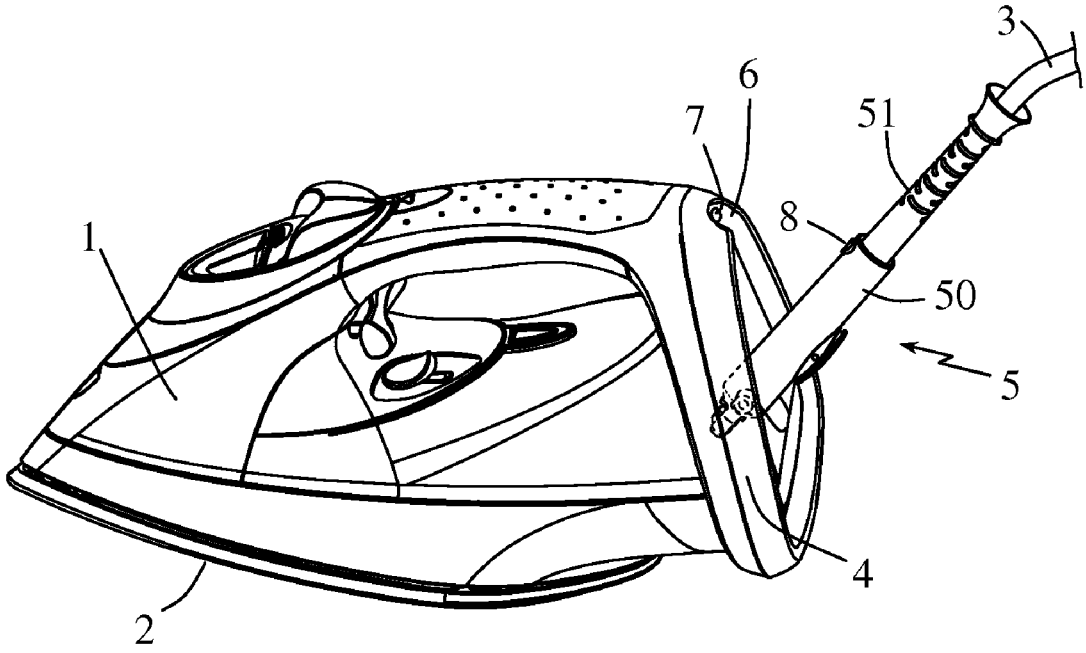

FIGS. 1 and 2 represent a first embodiment of a pressing iron according to the invention. This pressing iron has, in a manner known per se, a body 1 surmounting a soleplate 2 heated by an electric resistance, the latter being supplied with electricity and steam by means of a cord 3 connected to a separate steam generator, not represented in the figures.

In accordance with FIG. 1, body 1 has a handle that is connected to the rear of the iron by two arms 4 delimiting between them an open space provided with an opening where power supply cord 3 penetrates inside body 1.

The cord exit from body 1 comprises a cord guide device 5 having a sleeve 50 of rigid plastic material extending around cord 3, cord guide device 5 having an extension 51 of flexible plastic material sliding inside sleeve 50 and making it possible to vary the length over which the cord is supported by cord guide device 5.

Sleeve 50 is articulated at its lower end and can pivot between a storage position, illustrated in FIG. 1, in which sleeve 50 is next to body 1 of the iron to minimize its bulk, and an ironing position, illustrated in FIG. 2, in which sleeve 50 is rocked backwards in order to incline cord 3 well behind the iron.

In an advantageous way, the rear of the iron has a reception notch 6 in which sleeve 50 comes to engage in storage position in order to allow a better integration of the cord guide device into body 1 of the iron.

More particularly according to the invention, the pressing iron has magnetic means generating a force of attraction tending to maintain sleeve 50 in storage position.

These magnetic means are advantageously constituted by a magnet 7 disposed at the level of reception notch 6, which interacts with a ferromagnetic disc 8 carried by sleeve 50, at the location coming to face magnet 7 when sleeve 50 is arranged in notch 6. As an example, magnet 7 and disc 8 can be fastened respectively on body 1 of the iron and on sleeve 50 or be integrated directly therein during the molding of these plastic parts.

The pressing iron thus produced has the advantage of having a very great ergonomics of use, the magnetic locking of the cord guide device making it possible to maintain the latter in storage position when the user wishes to store the iron. Moreover, such a cord guide device has the advantage of rocking towards the ironing position by a simple backward pull on the cord guide device, which makes it possible to obtain an automatic rocking of the cord guide device towards the ironing position during an ironing session, simply in response to a pull is exerted on the cord.

Figure 3:
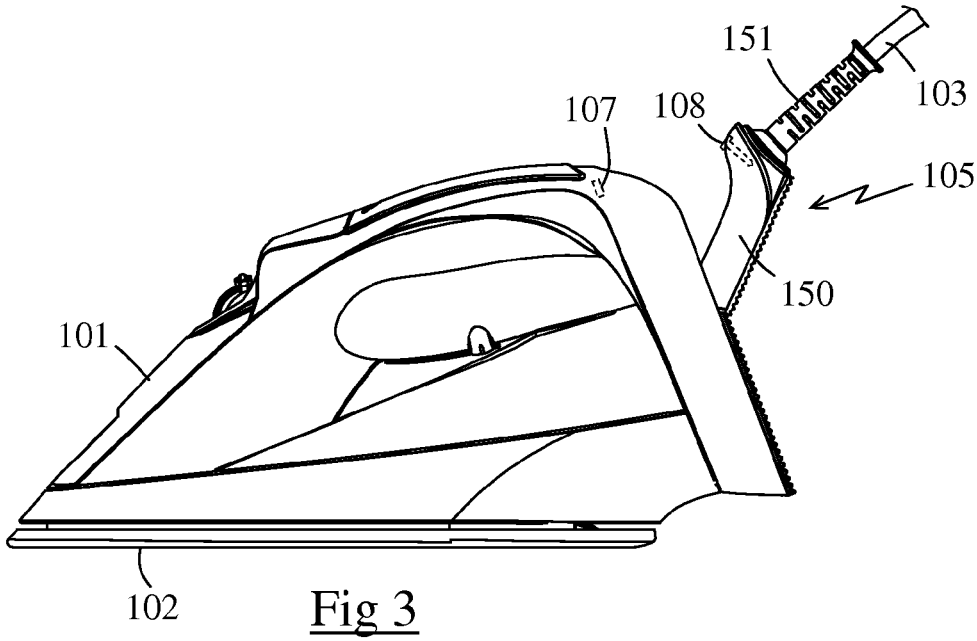
FIG. 3 is a perspective side view of a pressing iron according to a second particular embodiment of the invention.
Figure 4:
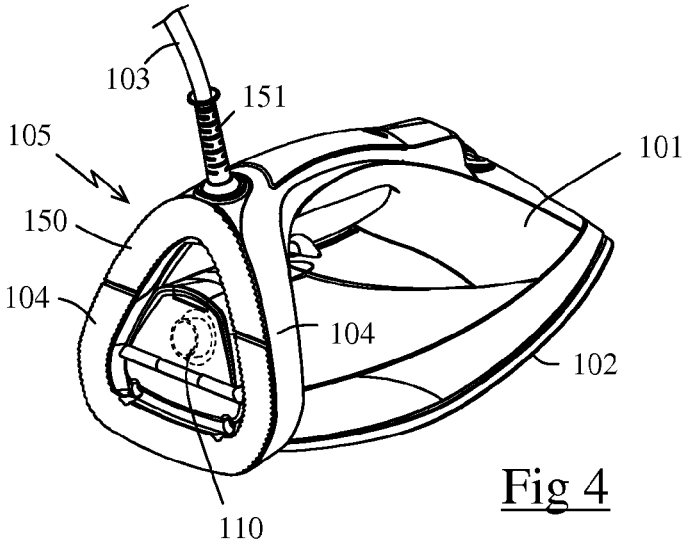
FIGS. 4 and 5 are perspective views of the iron of FIG. 3 when the cord guide device is respectively in storage position and ironing position.
Figure 5:
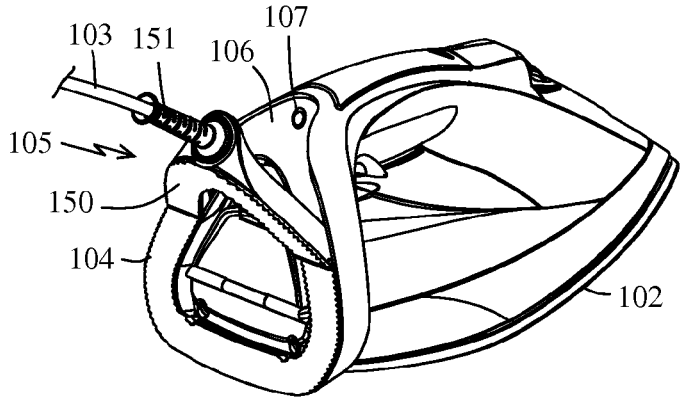

FIGS. 3 to 5 represent a second embodiment of a pressing iron according to the invention, in which the iron has a plastic body 101 containing a water reservoir and surmounting a soleplate 102 heated by an electric resistance, the latter being fed electrically by means of a cord 103 whose end is provided with a plug, not represented in the figures, allowing its connection to the electrical supply mains.

The iron has a heel having two arms 104 delimiting between them an open space in which is disposed a rotatable obturator blocking a filling opening 110 of the water reservoir, represented in broken lines in FIG. 4.

The iron has a cord guide device 105 having a flexible sleeve 151 enveloping the exit of the cord, which is mounted at the top of an arch 150 articulated on arms 104 of the heel. Arch 150 can rock from a storage position, in which arch 150 is integrated in a recess 106 in the upper part of arms 104, as thus illustrated in FIG. 4, towards an ironing position in which arch 150 is rocked towards the rear of the iron, as illustrated in FIGS. 3 and 5.

The wires of cord 103 may extend into body 101 through arch 150. For example, each of the two wires of cord 103 may extend through a respective leg of arch 150 and from there into body 101. An arrangement of this type is disclosed in published International Application WO 2008/040858, published on Apr. 10, 2008, the disclosure of which is incorporated herein by reference.

In ironing position, cord guide device 105 makes it possible to off-set the cord exit towards the rear of the iron, which in particular makes it possible to prevent cord 103 from coming to rub on the edge of the ironing board or on the linen during ironing. In storage position, arch 150 has the advantage of being integrated into body 101 of the iron, which makes it possible to preserve small overall dimensions facilitating storage of the iron. Moreover, in this storage position, arch 150 forms, with the lower part of the heel, a flat surface on which the iron can rest in a stable way.

In accordance with the invention, arch 150 comprises an assembly screw 108 of ferromagnetic material that comes into the immediate vicinity of a magnet 107 disposed in recess 106 of the heel when arch 150 is in storage position, so that the magnetic attraction generated by magnet 107 on screw 108 maintains arch 150 in storage position. In a preferential manner, magnet 107 is immobilized by cementing or while being sandwiched between two assembly parts of body 101 of the iron.

The pressing iron thus produced has the advantage of having a magnetic restraint system of the cord guide device in storage position which cooperates with an assembly screw of the iron so that the number of components and thus the necessary cost of magnetic retaining device is reduced.

Of course, the invention is by no means limited to the described and illustrated embodiments, which were given only as an example. Modifications remain possible, in particular from the point of view of the constitution of the various elements or by substitution of technical equivalents, without leaving for all that the field of protection of the invention.

Thus in an alternative embodiment of the invention, the magnet could be carried by the cord guide device and cooperate with a ferromagnetic element carried by the body of the iron.

This application relates to subject matter disclosed in French Application number FR 07 07175, filed on Oct. 12, 2007, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. A fabric pressing iron comprising: a body; a cord connected to said body and exiting from said body, and a cord guide device giving a preferential orientation to said cord at the exit from said body, said cord guide device being articulated on said body and being able to rock between a storage position in which said cord guide device is disposed against said body and an ironing position in which said cord guide device is spaced from said iron, wherein said iron further comprises magnetic means located for generating a force tending to maintain said cord guide device in storage position.

2. The iron according to claim 1, wherein said magnetic means are constituted by a magnet and a ferromagnetic element that cooperates with said magnet to maintain said cord guide device in the storage position.

3. The iron according to claim 2, wherein said ferromagnetic element is constituted by an assembly screw of said iron.

4. The iron according to claim 3, wherein: said cord guide device comprises a sleeve enveloping said cord at the exit from said body and articulated on said body; said magnet is carried by said sleeve and said ferromagnetic element is carried by said body.

5. The iron according to claim 3, wherein: said cord guide device comprises a part in the form of an arch supporting said cord; said arch has ends that are articulated on said body; said magnet is carried by said body; and said assembly screw is mounted on said arch at a location to come into the immediate vicinity of said magnet when said arch is in storage position.

6. The iron according to claim 2, wherein: said cord guide device comprises a sleeve enveloping said cord at the exit from said body and articulated on said body; said magnet is mounted on said sleeve and said ferromagnetic element is carried by said body.

7. The iron according to claim 2, wherein: said cord guide device comprises a part in the form of an arch supporting said cord; said arch has ends that are articulated on said body; said magnet is carried by said body; and said ferromagnetic element is an assembly screw mounted on said arch at a location to come into the immediate vicinity of said magnet when said arch is in storage position.

8. The iron according to claim 1, wherein: said cord guide device comprises a sleeve enveloping said cord at the exit from said body; said sleeve is articulated on said body; and said magnetic means comprise a magnet carried by said sleeve and a ferromagnetic element carried by said body and cooperating with said magnet to maintain said cord guide device in storage position.

9. The iron according to any claim 1, wherein: said cord guide device comprises a part in the form of an arch supporting said cord; said arch has ends that are articulated on said body; and said magnetic means comprise a magnet carried by said arch and a ferromagnetic element constituted by an assembly screw carried by said body at a location to come into the immediate vicinity of said magnet when said arch is in storage position.

* * * * *